US008866716B2

(12) United States Patent
Mizumaki et al.

(10) Patent No.: US 8,866,716 B2
(45) Date of Patent: Oct. 21, 2014

(54) LIQUID CRYSTAL DISPLAY DEVICE AND DRIVING METHOD USING ALTERNATIVE GRAY-SCALE VOLTAGE

(75) Inventors: Hidetaka Mizumaki, Nara (JP); Daiichi Sawabe, Tsu (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 2867 days.

(21) Appl. No.: 11/189,741

(22) Filed: Jul. 27, 2005

(65) Prior Publication Data

US 2006/0022926 A1 Feb. 2, 2006

(30) Foreign Application Priority Data

Jul. 28, 2004 (JP) ..... 2004-219557
Jun. 15, 2005 (JP) ..... 2005-174731

(51) Int. Cl.
*G09G 3/36* (2006.01)
*G09G 3/20* (2006.01)

(52) U.S. Cl.
CPC ..... *G09G 3/3648* (2013.01); *G09G 2320/0261* (2013.01); *G09G 3/2011* (2013.01); *G09G 2320/041* (2013.01); *G09G 2340/16* (2013.01); *G09G 2320/0257* (2013.01)
USPC ..... 345/94; 345/87; 345/89; 345/95

(58) Field of Classification Search
USPC ..... 345/690, 87–104
See application file for complete search history.

(56) References Cited

U.S. PATENT DOCUMENTS 6,952,192 B2 * 10/2005 Ohmuro et al. ..... 345/87
6,972,745 B2 * 12/2005 Pfeiffer et al. ..... 345/89
7,119,772 B2 * 10/2006 Amundson et al. ..... 345/87
7,304,624 B2 * 12/2007 Lee ..... 345/89
7,362,296 B2 * 4/2008 Song et al. ..... 345/89
7,375,723 B2 * 5/2008 Cheon et al. ..... 345/204
7,391,400 B2 * 6/2008 Kubo et al. ..... 345/89
7,420,538 B2 * 9/2008 Murao et al. ..... 345/101
2001/0040546 A1 * 11/2001 Ohmuro et al. ..... 345/87
2002/0033789 A1 3/2002 Miyata et al.
2002/0036740 A1 3/2002 Kubo et al.
2002/0047821 A1 4/2002 Miyake
2002/0050965 A1 5/2002 Oda et al.

(Continued)

FOREIGN PATENT DOCUMENTS

JP 59-154884 3/1984
JP 2000-231091 8/2000
JP 2003-43525 2/2003

OTHER PUBLICATIONS

European Search Report.

*Primary Examiner* — Gene W Lee

(74) *Attorney, Agent, or Firm* — Harness, Dickey & Pierce, P.L.C.

(57) ABSTRACT

The driving circuit of the liquid crystal display device according to the present invention classifies a combination of a displayed gray-scale level of a previous vertical scanning period and a regular gray-scale level corresponding to an input image signal in a current vertical scanning period into either a first group or a second group. The driving circuit is capable of supplying the gray-scale voltage corresponding to the regular gray-scale level for any combination belonging to the first group, and supplying a gray-scale voltage corresponding to an alternative gray-scale level which is different from the regular gray-scale level for any combination belonging to the second group.

23 Claims, 7 Drawing Sheets

(56) References Cited

U.S. PATENT DOCUMENTS

| | | | | |
|---|---|---|---|---|
| 2003/0098839 | A1* | 5/2003 | Lee | 345/89 |
| 2003/0231158 | A1 | 12/2003 | Someya et al. | |
| 2004/0027322 | A1* | 2/2004 | Chen et al. | 345/89 |
| 2004/0041767 | A1* | 3/2004 | Sugino | 345/89 |
| 2004/0125063 | A1* | 7/2004 | Lee et al. | 345/89 |
| 2005/0001802 | A1* | 1/2005 | Lee | 345/89 |
| 2005/0068282 | A1* | 3/2005 | Mizumaki | 345/89 |
| 2005/0270262 | A1* | 12/2005 | Oh | 345/89 |

* cited by examiner

| Displayed Gray-Scale Level of Previous Frame \ Regular Gray-Scale Level of Current Frame | 0 | 63 | 127 | 191 | 255 |
|---|---|---|---|---|---|
| 0 | 0 | **43** | 127 | 191 | 255 |
| 63 | 0 | 63 | 127 | 191 | 255 |
| 127 | 0 | **73** | 127 | 191 | 255 |
| 191 | 0 | **83** | 127 | 191 | 255 |
| 255 | 0 | **93** | 127 | 191 | 255 |

*FIG.8*

| | | Regular Gray-Scale Level of Current Frame (Luminance Ratio) | | | | | | | | |
|---|---|---|---|---|---|---|---|---|---|---|
| | | 0 | 0.05 | 0.10 | 0.15 | 0.20 | 0.25 | 0.30 | ··· | 1.00 |
| Displayed Gray-Scale Level of Previous Frame (Luminance Ratio) | 0 | 0 | 0.02 | 0.02 | 0.27 | 0.27 | 0.27 | 0.30 | ··· | 1.00 |
| | 0.05 | 0 | 0.02 | 0.02 | 0.27 | 0.27 | 0.27 | 0.30 | ··· | 1.00 |
| | 0.10 | 0 | 0.02 | 0.02 | 0.27 | 0.27 | 0.27 | 0.30 | ··· | 1.00 |
| | 0.15 | 0 | 0.02 | 0.02 | 0.27 | 0.27 | 0.27 | 0.30 | ··· | 1.00 |
| | 0.20 | 0 | 0.02 | 0.02 | 0.27 | 0.27 | 0.27 | 0.30 | ··· | 1.00 |
| | 0.25 | 0 | 0.02 | 0.02 | 0.27 | 0.27 | 0.27 | 0.30 | ··· | 1.00 |
| | ⋮ | ⋮ | ⋮ | ⋮ | ⋮ | ⋮ | ⋮ | ⋮ | | ⋮ |
| | 1.00 | 0 | 0.02 | 0.02 | 0.27 | 0.27 | 0.27 | 0.30 | ··· | 1.00 |

*FIG.9*

| | Regular Gray-Scale Level of Current Frame (Luminance Ratio) | | | | | | | | |
|---|---|---|---|---|---|---|---|---|---|
| | 0 | 0.05 | 0.10 | 0.15 | 0.20 | 0.25 | 0.30 | ··· | 1.00 |
| Supplied Gray-Scale Voltage Level (Luminance Ratio) | 0 | 0.02 | 0.02 | 0.27 | 0.27 | 0.27 | 0.30 | ··· | 1.00 |

LIQUID CRYSTAL DISPLAY DEVICE AND DRIVING METHOD USING ALTERNATIVE GRAY-SCALE VOLTAGE

BACKGROUND OF THE INVENTION

1. Field of the Invention

The present invention relates to a liquid crystal display device, and more particularly relates to a liquid crystal display device having excellent moving picture displaying characteristics.

2. Description of the Related Art

In recent years, liquid crystal display devices have come into wide use. Recently, there has been a rapidly increasing need to display moving picture information, not only on liquid crystal television sets, but also on monitor devices for personal computers and portable terminal devices (such as mobile phones or PDAs). In order to display high-quality moving pictures on a liquid crystal display device, it is necessary to reduce the response time (i.e., increase the response speed) of the liquid crystal layer, and it is a requirement that a predetermined gray-scale level be reached within one vertical scanning period (typically one frame).

As a driving method for improving the response characteristics of a liquid crystal display device, there is known a method (referred to as "overshoot driving") that involves applying a voltage (referred to as an "overshoot voltage") which is higher than a voltage (a predetermined gray-scale voltage) corresponding to a gray-scale level that needs to be displayed.

By applying an overshoot voltage, the response characteristics in gray-scale display can be improved. For example, Japanese Laid-Open Patent Publication No. 2000-231091 discloses an MVA-type liquid crystal display device which operates by overshoot driving. MVA-type liquid crystal display devices are gaining prevalence in recent years because of having better viewing angle characteristics than those of TN-type liquid crystal display devices, which have conventionally been most prevalent.

However, in order to perform overshoot driving, it is necessary to set an optimum overshoot voltage according to the type and specifications of each liquid crystal panel, and such setting can be very cumbersome. Moreover, in order to perform desirable overshoot driving, a circuit construction including large-capacity memories and/or a circuit construction for performing complicated calculations are necessary, thus resulting in an increased production cost.

SUMMARY OF THE INVENTION

In order to overcome the problems described above, preferred embodiments of the present invention provide a liquid crystal display device which is capable of high-quality displaying of moving pictures with a simple constitution, and a driving method for the same.

A liquid crystal display device according to the present invention comprises: a liquid crystal panel having a liquid crystal layer and at least a pair of electrodes for applying a voltage across the liquid crystal layer; and a driving circuit for supplying a driving voltage to the liquid crystal panel, wherein, the driving circuit classifies a combination of a displayed gray-scale level of a previous vertical scanning period and a regular gray-scale level corresponding to an input image signal in a current vertical scanning period into either a first group or a second group, such that the combination is classified into the first group if a luminance $L_1+(L_2-L_1)\cdot C_1$ is reached within a period corresponding to one vertical scanning period when a gray-scale voltage corresponding to the regular gray-scale level is supplied (where $L_1$ is a luminance corresponding to the displayed gray-scale level of the previous vertical scanning period; $L_2$ is a luminance corresponding to the regular gray-scale level; and $C_1$ is a predetermined constant which is greater than zero and equal to or less than 1), and otherwise classified into the second group, and the driving circuit is capable of supplying the gray-scale voltage corresponding to the regular gray-scale level for any combination belonging to the first group, and supplying a gray-scale voltage corresponding to an alternative gray-scale level which is different from the regular gray-scale level for any combination belonging to the second group, the alternative gray-scale level being defined so that a luminance $L_1+(L_3-L_1)\cdot C_2$ is reached within a period corresponding to one vertical scanning period when the gray-scale voltage corresponding to the alternative gray-scale level is supplied (where $L_3$ is a luminance corresponding to the alternative gray-scale level; and $C_2$ is a predetermined constant which is greater than zero and equal to or less than 1). Thus, the aforementioned objective is met.

In a preferred embodiment, the predetermined constants $C_1$ and $C_2$ are equal to each other.

In a preferred embodiment, the predetermined constant $C_1$ is equal to or greater than 0.8.

In a preferred embodiment, when the gray-scale voltage corresponding to the regular gray-scale level is supplied for any combination belonging to the first group, at least a luminance change from $L_1+0.2\cdot(L_2-L_1)$ to $L_1+0.8\cdot(L_2-L_1)$ occurs within a period corresponding to one vertical scanning period.

In a preferred embodiment, the predetermined constant $C_1$ is equal to or greater than 0.9.

In a preferred embodiment, when the gray-scale voltage corresponding to the regular gray-scale level is supplied for any combination belonging to the first group, at least a luminance change from $L_1+0.1\cdot(L_2-L_1)$ to $L_1+0.9\cdot(L_2-L_1)$ occurs within a period corresponding to one vertical scanning period.

In a preferred embodiment, the predetermined constant $C_2$ is equal to or greater than 0.8.

In a preferred embodiment, when the gray-scale voltage corresponding to the alternative gray-scale level is supplied for any combination belonging to the second group, at least a luminance change from $L_1+0.2(L_3-L_1)$ to $L_1+0.8\cdot(L_3-L_1)$ occurs within a period corresponding to one vertical scanning period.

In a preferred embodiment, the predetermined constant $C_2$ is equal to or greater than 0.9.

In a preferred embodiment, when the gray-scale voltage corresponding to the alternative gray-scale level is supplied for any combination belonging to the second group, at least a luminance change from $L_1+0.1\cdot(L_3-L_1)$ to $L_1+0.9\cdot(L_3-L_1)$ occurs within a period corresponding to one vertical scanning period.

In a preferred embodiment, the alternative gray-scale level is a gray-scale level which is intermediate between the regular gray-scale level and the displayed gray-scale level of the previous vertical scanning period.

In a preferred embodiment, the driving circuit refers to a look-up table for the combination of the displayed gray-scale level of the previous vertical scanning period and the regular gray-scale level corresponding to the input image signal in the current vertical scanning period, and supplies a gray-scale voltage based on the look-up table.

Alternatively, a liquid crystal display device according to the present invention comprises: a liquid crystal panel having a liquid crystal layer and at least a pair of electrodes for applying a voltage across the liquid crystal layer; and a driving circuit for supplying a driving voltage to the liquid crystal panel, wherein, the driving circuit includes a signal conversion section for converting an input image signal in a current vertical scanning period into a predetermined gray-scale data in accordance with a combination of a displayed gray-scale level of a previous vertical scanning period and a regular gray-scale level corresponding to an input image signal in a current vertical scanning period; the signal conversion section includes a first memory for storing gray-scale data in a previous vertical scanning period, and a second memory storing gray-scale data corresponding to at least some of all possible combinations of a displayed gray-scale level of a previous vertical scanning period and a regular gray-scale level corresponding to an input image signal in a current vertical scanning period; and each piece of gray-scale data stored in the second memory is selected so that an amount of luminance change, being no less than a predetermined fraction of a target change amount, will result within a period corresponding to one vertical scanning period after a gray-scale voltage corresponding to the gray-scale data is supplied, wherein the target change amount is a difference between a luminance when the liquid crystal layer has reached a stationary state after the gray-scale voltage corresponding to the gray-scale data is supplied and a luminance corresponding to the displayed gray-scale level of the previous vertical scanning period.

In a preferred embodiment, the second memory stores gray-scale data corresponding to only some of all possible combinations of a displayed gray-scale level of a previous vertical scanning period and a regular gray-scale level corresponding to an input image signal in a current vertical scanning period; and the signal conversion section further includes a calculation circuit for generating, from the gray-scale data corresponding to only some of all possible combinations stored in the second memory, gray-scale data corresponding to any other combination.

Alternatively, a liquid crystal display device according to the present invention comprises: a liquid crystal panel having a liquid crystal layer and at least a pair of electrodes for applying a voltage across the liquid crystal layer; and a driving circuit for supplying a driving voltage to the liquid crystal panel, wherein, depending on a regular gray-scale level corresponding to an input image signal in a current vertical scanning period, the driving circuit is capable of supplying a gray-scale voltage corresponding to the regular gray-scale level if the regular gray-scale level is a gray-scale level falling within a specific range, and supplying a gray-scale voltage corresponding to an alternative gray-scale level which is different from the regular gray-scale level but which falls within the specific range if the regular gray-scale level is a gray-scale level falling outside the specific range, the specific range being predefined so that a luminance of no less than $L_1+(L_2-L_1)\cdot C$ is reached when a period corresponding to one vertical scanning period has elapsed since a gray-scale voltage corresponding to a gray-scale level falling within the specific range is supplied in a black displaying state, and that a luminance less than $L_1+(L_2-L_1)\cdot C$ results when a period corresponding to one vertical scanning period has elapsed since a gray-scale voltage corresponding to a gray-scale level falling outside the specific range is applied in a black displaying state (where $L_1$ is a luminance corresponding to the displayed gray-scale level of the previous vertical scanning period; $L_2$ is a luminance corresponding to the regular gray-scale level; and C is a predetermined constant which is greater than zero and equal to or less than 1)., Thus, the aforementioned objective is met.

In a preferred embodiment, the predetermined constant C is equal to or greater than 0.8.

In a preferred embodiment, when a gray-scale voltage corresponding to a gray-scale level falling within the specific range is supplied in a black displaying state, at least a luminance change from $L_1+0.2\cdot(L_2-L_1)$ to $L_1+0.8\cdot(L_2-L_1)$ occurs within a period corresponding to one vertical scanning period.

In a preferred embodiment, the predetermined constant C is equal to or greater than 0.9.

In a preferred embodiment, when a gray-scale voltage corresponding to a gray-scale level falling within the specific range is supplied in a black displaying state, at least a luminance change from $L_1+0.1(L_2-L_1)$ to $L_1+0.9\cdot(L_2-L_1)$ occurs within a period corresponding to one vertical scanning period.

In a preferred embodiment, the liquid crystal layer is a vertical-alignment type liquid crystal layer.

In a preferred embodiment, the liquid crystal display device according to the present invention further comprises a temperature sensor for detecting a temperature of the liquid crystal panel, wherein the driving circuit only supplies a gray-scale voltage corresponding to the regular gray-scale level if the temperature of the liquid crystal panel as detected by the temperature sensor is equal to or greater than a predetermined temperature.

In a preferred embodiment, the predetermined temperature is 40° C.

In a preferred embodiment, after a predetermined time has elapsed since activation of the liquid crystal display device, the driving circuit only supplies a gray-scale voltage corresponding to the regular gray-scale level.

According to the present invention, there is also provided a driving method for a liquid crystal display device including a liquid crystal panel having a liquid crystal layer and at least a pair of electrodes for applying a voltage across the liquid crystal layer, the method comprising: step (a) of classifying a combination of a displayed gray-scale level of a previous vertical scanning period and a regular gray-scale level corresponding to an input image signal in a current vertical scanning period into either a first group or a second group, such that the combination is classified into the first group if a luminance $L_1+(L_2-L_1)\cdot C_1$ is reached within a period corresponding to one vertical scanning period when a gray-scale voltage corresponding to the regular gray-scale level is supplied (where $L_1$ is a luminance corresponding to the displayed gray-scale level of the previous vertical scanning period; $L_2$ is a luminance corresponding to the regular gray-scale level; and $C_1$ is a predetermined constant which is greater than zero and equal to or less than 1), and otherwise classified into the second group; step (b) of supplying the gray-scale voltage corresponding to the regular gray-scale level for any combination belonging to the first group; and step (c) of supplying a gray-scale voltage corresponding to an alternative gray-scale level which is different from the regular gray-scale level for any combination belonging to the second group, wherein the alternative gray-scale level is defined so that a luminance $L_1+(L_3-L_1)\cdot C_2$ is reached within a period corresponding to one vertical scanning period when the gray-scale voltage corresponding to the alternative gray-scale level is supplied (where $L_3$ is a luminance corresponding to the alternative gray-scale level; and $C_2$ is a predetermined constant which is greater than zero and equal to or less than 1).

In a preferred embodiment, step (a) is executed by referring to a look-up table for the combination of the displayed gray-scale level of the previous vertical scanning period and the regular gray-scale level corresponding to the input image signal in the current vertical scanning period; and step (b) and step (c) are executed by supplying a gray-scale voltage based on the look-up table.

According to the present invention, there is provided a liquid crystal display device which is capable of high-quality displaying of moving pictures with a simple constitution, as well as a driving method for the same. The liquid crystal display device according to the present invention is suitably used in various electronic apparatuses.

Other features, elements, processes, steps, characteristics and advantages of the present invention will become more apparent from the following detailed description of preferred embodiments of the present invention with reference to the attached drawings.

BRIEF DESCRIPTION OF THE DRAWINGS

FIG. 8 is a diagram showing a relationship between a displayed gray-scale level of a previous frame and a regular gray-scale level of a current frame, as well as a gray-scale voltage level which is actually supplied by a driving circuit of the liquid crystal display device 200.

FIG. 9 is a diagram showing an exemplary look-up table which is referred to by a driving circuit of the liquid crystal display device 200.

DETAILED DESCRIPTION OF PREFERRED EMBODIMENTS

Hereinafter, preferred embodiments of the present invention will be described with reference to the accompanying drawings. It will be appreciated that the present invention is not to be limited to the following embodiments.

(Embodiment 1)

Figure 1:
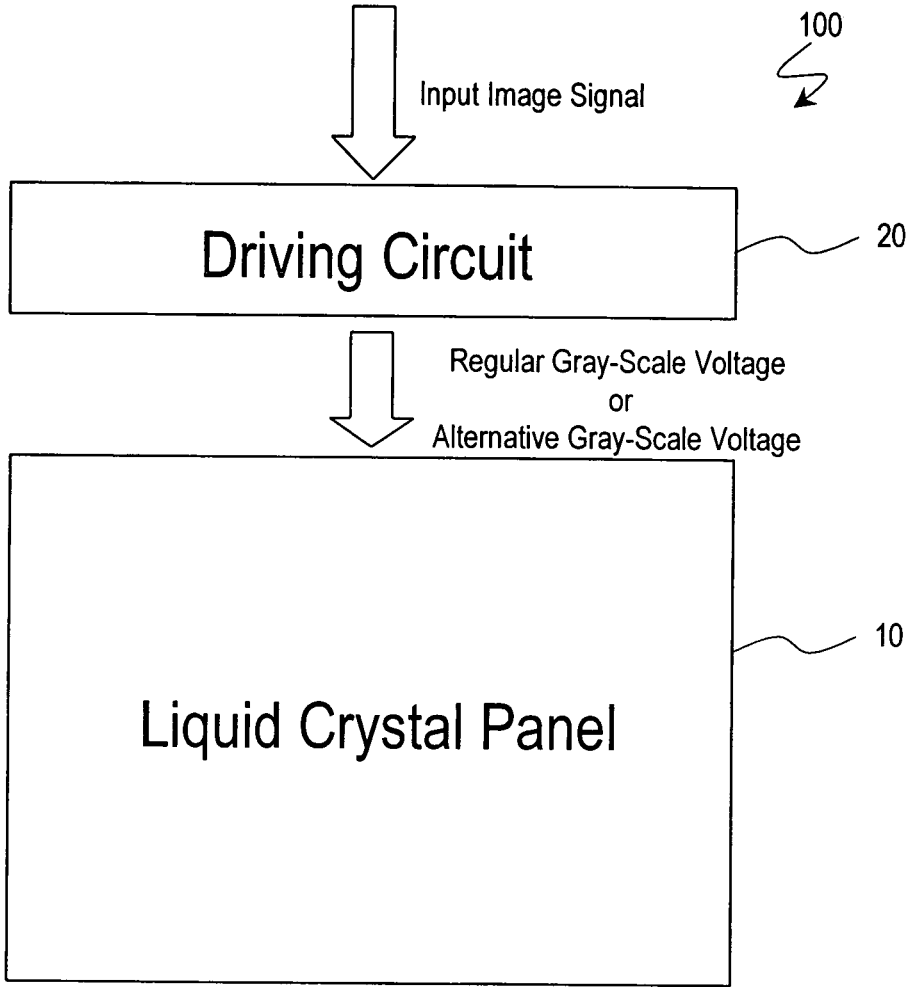
FIG. 1 is a block diagram schematically showing a liquid crystal display device 100 according to an embodiment of the present invention.

FIG. 1 schematically shows a liquid crystal display device 100 according to the present embodiment. The liquid crystal display device 100 comprises a liquid crystal panel 10 and a driving circuit 20.

The liquid crystal panel 10 includes a liquid crystal layer and a pair of electrodes for applying a voltage across the liquid crystal layer. The liquid crystal layer is interposed between a pair of substrates (e.g., glass substrates). Electrodes are provided on a surface of each substrate facing the liquid crystal layer. A liquid crystal panel of any known structure is broadly applicable as the liquid crystal panel 10.

The driving circuit 20 supplies a driving voltage to the liquid crystal panel 10 in accordance with an input image signal. In accordance with the combination of a displayed gray-scale level of a previous vertical scanning period and a gray-scale level corresponding to an input image signal in the current vertical scanning period (also referred to as a "regular gray-scale level"), the driving circuit 20 of the present embodiment is capable of selectively supplying either: a gray-scale voltage corresponding to the regular gray-scale level (also referred to as a "regular gray-scale voltage"); or a gray-scale voltage (also referred to as an "alternative gray-scale voltage") corresponding to a gray-scale level which is different from the regular gray-scale level (also referred to as an "alternative gray-scale level")

Figures 2, 3:
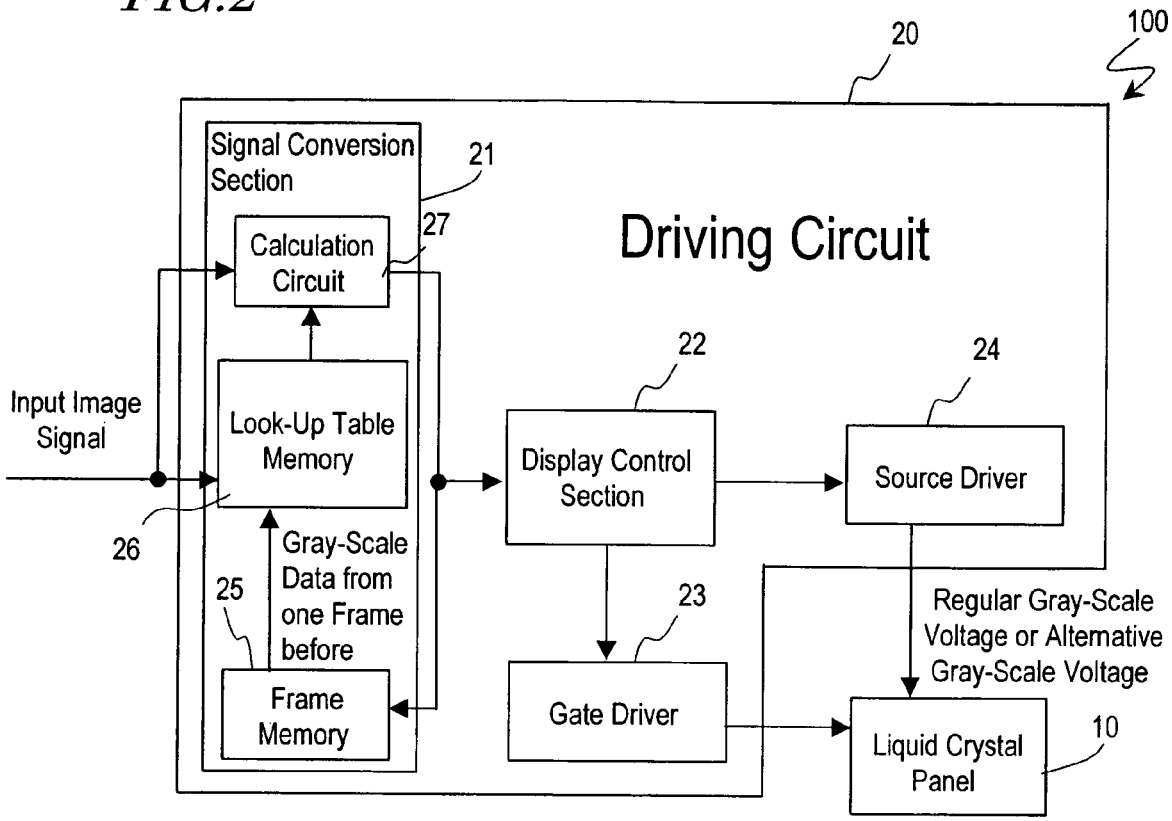
FIG. 2 is a block diagram schematically showing the liquid crystal display device 100 according to an embodiment of the present invention.
FIG. 3 is a diagram showing an exemplary look-up table which is referred to by a driving circuit of the liquid crystal display device 100.

Hereinafter, a more specific structure of the driving circuit 20 and the functions thereof will be described. The following descriptions will be directed the case where the liquid crystal panel 10 includes a vertical-alignment type liquid crystal layer and performs display in a normally black mode, where one vertical scanning period corresponds to one frame. FIG. 2 shows an exemplary specific structure of the driving circuit 20. The illustrated driving circuit 20 includes a signal conversion section 21, a display control section 22, a gate driver 23, and a source driver 24.

The signal conversion section 21 receives an externally-input image signal, and converts the signal into a signal (gray-scale data) for supplying gray-scale voltages. Based on the gray-scale data which is output from the signal conversion section 21, the display control section 22 sends a control signal to the gate driver 23 and the source driver 24. The gate driver 23, which is coupled to gate lines in the liquid crystal panel 10, supplies a gate voltage to a gate electrode of each TFT, in accordance with a control signal received from the display control section 22. The source driver 24, which is connected to source lines in the liquid crystal panel 10, supplies a source voltage (i.e., a regular gray-scale voltage or an alternative gray-scale voltage) to a source electrode of each TFT, in accordance with a control signal received from the display control section 22.

The signal conversion section 21 in the present embodiment includes a frame memory 25, a look-up table (LUT) memory 26, and a calculation circuit 27. The frame memory 25 retains the gray-scale data from one frame before.

The LUT memory 26 stores a look-up table. As shown in FIG. 3, for example, the look-up table has a two-dimensional matrix structure of 5 rows×5 columns. From each combination of a regular gray-scale level of a current frame and a displayed gray-scale level of a previous frame, a single gray-scale level to be displayed (0 to 255) is determined. As shown in FIG. 3, the gray-scale level to be displayed, which is determined based on the combination of a regular gray-scale level of a current frame and a displayed gray-scale level of a previous frame, may be the regular gray-scale level of the current frame or an alternative gray-scale level (shown underlined in FIG. 3) which is different from the regular gray-scale level. For example, consider a combination in which the displayed gray-scale level of the previous frame is the $0^{th}$ gray-scale level and the regular gray-scale level of the current frame is the $63^{rd}$ gray-scale level. In this case, the gray-scale level to be displayed is the $43^{rd}$ gray-scale level, rather than the $63^{rd}$ gray-scale level (which would be the regular gray-scale level). As described herein, in the present specification, "a displayed gray-scale level of a frame" refers to that which is determined by a constituent element of the driving circuit 20 (i.e., the signal conversion section 21 in this example) for each single frame (which is assumed to be constant within the frame), rather than the actual luminance of the liquid crystal panel (which may vary within a single frame), unless otherwise specified. The same is also true of "a displayed gray-scale level of a vertical scanning period".

The calculation circuit 27 generates gray-scale data based on each gray-scale level to be displayed which is determined based on the LUT which is retained or stored in the LUT memory 26. Note that the look-up table illustrated in FIG. 3 does not describe all possible combinations of gray-scale levels, but rather describes combinations corresponding to gray-scale levels sampled every $64^{th}$ gray-scale level. For instance, the look-up table provides combinations for the $0^{th}$ gray-scale level, the $63^{rd}$ gray-scale level, the $127^{th}$ gray-scale level, the $191^{st}$ and the $255^{th}$ gray-scale level. In this case, the calculation circuit 27 generates any gray-scale level that corresponds to a combination which is not described in the look-up table through an interpolation calculation from the described combinations. Thus, by limiting the number of combinations described in the LUT, the required capacity of the LUT memory 26 can be reduced. However, it will be appreciated that an LUT having a matrix structure of 256 rows×256 columns, thus describing all possible combinations of gray-scale levels, may instead be provided.

As described above, the driving circuit 20 in the present embodiment supplies gray-scale voltages in accordance with the gray-scale data which has been calculated by the calculation circuit 27. As shown in FIG. 3, the look-up table selectively describes either a regular gray-scale level or an alternative gray-scale level, with respect to each combination of a displayed gray-scale level of a previous frame and a regular gray-scale level of a current frame. Therefore, by referring to the look-up table, the driving circuit 20 is able to selectively supply either a regular gray-scale voltage or an alternative gray-scale voltage to the liquid crystal panel 10.

Figure 4:
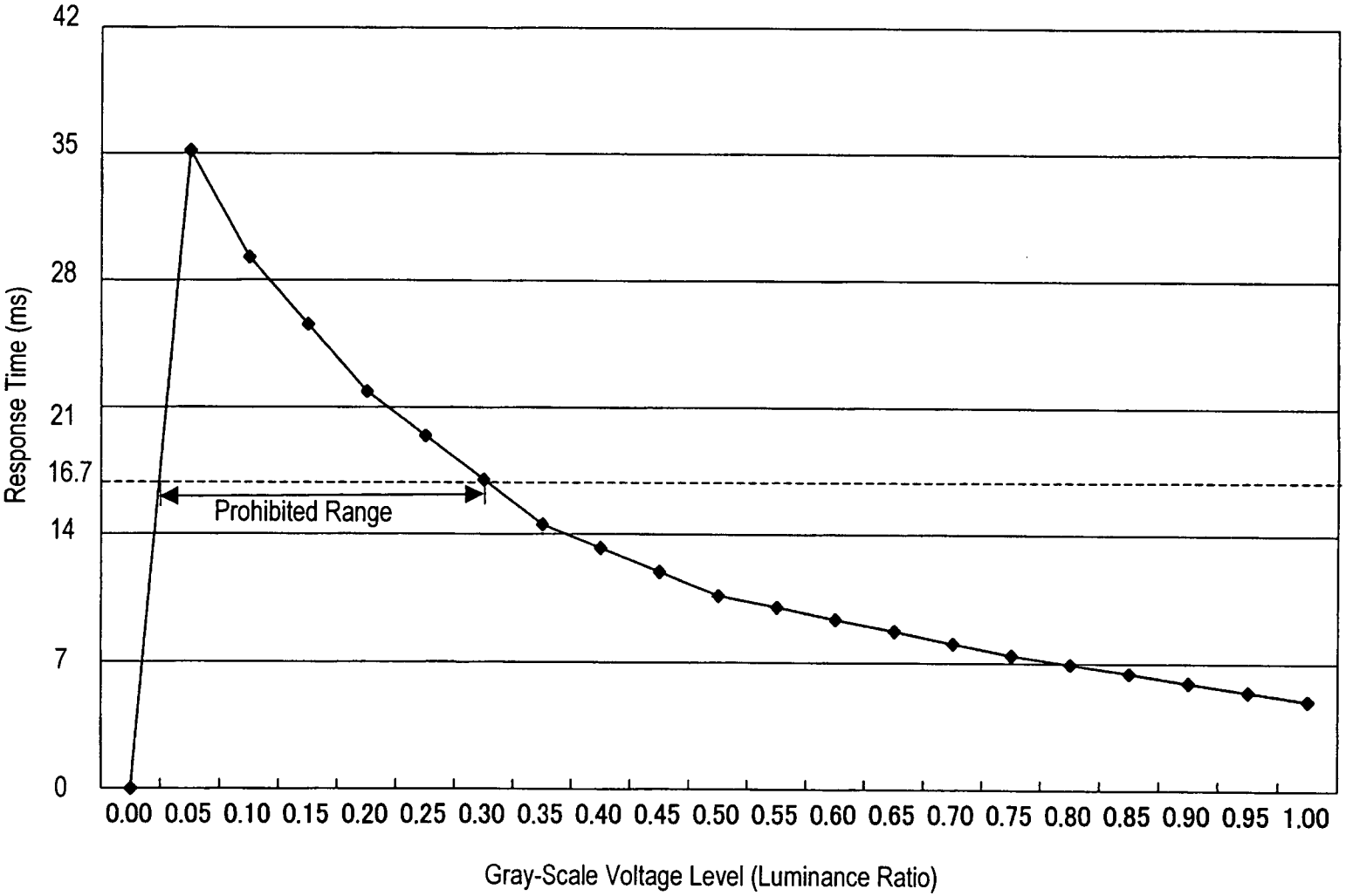
FIG. 4 is a graph showing exemplary response characteristics of a liquid crystal panel.

The look-up table shown in FIG. 3 is generated based on the response characteristics of the liquid crystal panel 10. FIG. 4 shows the response characteristics (taken at 0° C.) of a liquid crystal panel 10 of certain specifications, which includes a vertical-alignment type liquid crystal layer. FIG. 4 is a graph showing a relationship between a gray-scale voltage level and a response time (ms) when the gray-scale voltage is applied in a black displaying state (i.e., a state in which the lowest gray-scale level is being displayed). The gray-scale voltage level shown in the graph is a luminance ratio obtained by dividing the luminance (when a stationary state is attained) corresponding to an applied gray-scale voltage by the luminance in a white displaying state. Herein, the "black displaying state" is defined by a luminance of 0, whereas the "white displaying state" (i.e., a state in which the highest gray-scale level is being displayed) is defined by a luminance of 1. The response time shown in the graph is the "response time" in the general sense of the term, i.e., a length of time required for the luminance to change from 10% to 90% of the luminance in a stationary state.

As seen from FIG. 4, in the liquid crystal panel 10 having a vertical-alignment type liquid crystal layer, the response speed is slow and the response characteristics are poor when a gray-scale voltage corresponding to an intermediate tone of a low gray-scale level is applied. In the case where the liquid crystal panel 10 has a refresh rate of 60 Hz, for example, one frame is about 16.7 ms. Therefore, if any gray-scale voltage level associated with a response time exceeding 16.7 ms (as in the luminance ratio range greater than 0.02 and less than 0.27) in FIG. 4 is used, the amount of luminance change within a period corresponding to one frame would not reach 90% of the target (i.e., intended) amount of luminance change (which is expressed as a difference between the luminance corresponding to the displayed gray-scale level of a previous frame and the luminance corresponding to the gray-scale level of the current frame). Thus, in the present specification, a range of gray-scale levels in which the amount of luminance change within a period corresponding to one frame will not reach a predetermined fraction of a target change amount is referred to as a "prohibited range". The other range of gray-scale levels, i.e., a range in which the amount of luminance change within a period corresponding to one frame will reach a predetermined fraction of a target change amount, is referred to as a "tolerable range".

When creating the look-up table, for each combination of a displayed gray-scale level of a previous frame and a regular gray-scale level of a current frame, 1) the regular gray-scale level is selected if the regular gray-scale level of the current frame is within the tolerable range (i.e., outside the prohibited range); or 2) a gray-scale level (alternative gray-scale level) which is different from the regular gray-scale level is selected if the regular gray-scale level of the current frame falls outside the tolerable range (i.e., within the prohibited range). In other words, each piece of gray-scale data stored in the LUT memory 26 is selected so that, after a gray-scale voltage corresponding to the gray-scale data is supplied, the amount of luminance change will reach a predetermined fraction of a target change amount within a period corresponding to one frame (where the target change amount is a difference between: a luminance when the liquid crystal layer has reached a stationary state after a gray-scale voltage corresponding to the gray-scale data is supplied; and a luminance corresponding to the displayed gray-scale level of the previous frame).

For example, let us assume that a luminance a corresponds to a displayed gray-scale level A of the previous frame, and that a luminance b corresponds to a regular gray-scale level B of the current frame. In this case, if the actual amount of luminance change (amount of change occurring within a period corresponding to one frame) responsive to a change in gray-scale level from A to B is expected to be equal to or greater than a predetermined fraction of the target change amount (i.e., $|a-b|$), then B is described in the look-up table as the gray-scale level to be displayed. On the other hand, if the actual amount of luminance change is expected to be less than the predetermined fraction of the target change amount, an alternative gray-scale level C which will result in an amount of luminance change being equal to or greater than the predetermined fraction is described as the gray-scale level to be displayed in the look-up table, instead of B. If the gray-scale levels A and B satisfy the relationship $A<B$, the gray-scale levels A, B, and C satisfy the relationship "$A<C<B$". Conversely, if the gray-scale levels A and B satisfy the relationship $A>B$, the gray-scale levels A, B, and C satisfy the relationship "$A>C>B$".

The driving circuit 20 supplies a gray-scale voltage in accordance with the gray-scale data that is calculated by the calculation circuit 27 by referring to the look-up table (gray-scale conversion table) which has been prepared in the aforementioned manner. Therefore, the liquid crystal panel 10 will always receive a gray-scale voltage such that the resultant amount of luminance change will reach the predetermined fraction of the target change amount within one frame. Thus, occurrence of image blurring or the like due to slow response speed is reduced, and high-quality displaying of moving pictures is realized.

Figure 5A:
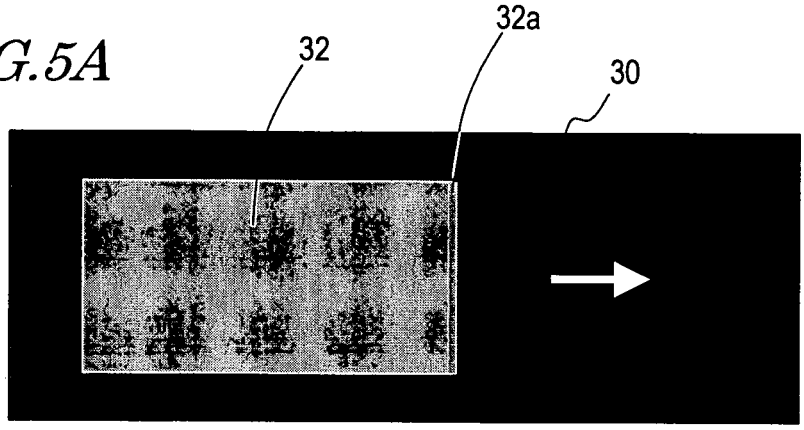
FIG. 5A is a diagram schematically showing image blurring.
Figure 5B:
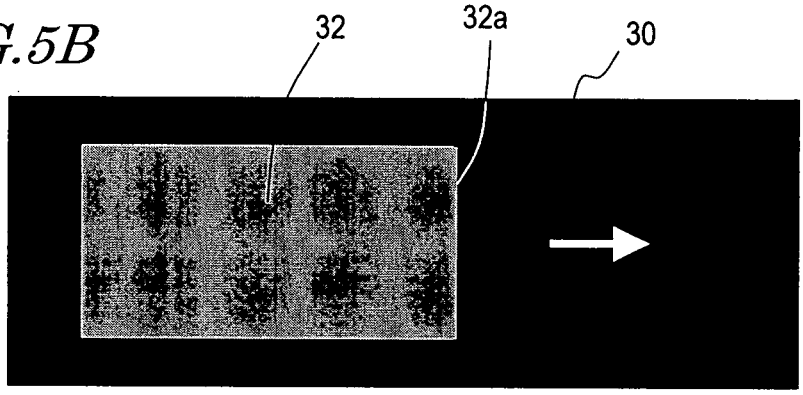
FIG. 5B is a diagram schematically showing suppression of image blurring.

Referring to FIGS. 5A and 5B, the reason why blurring is suppressed is described. FIGS. 5A and 5B each schematically show a rectangle 32 of an intermediate gray-scale tone being moved from the left to right, against a black (e.g., $0^{th}$ gray-scale level) background 30. FIG. 5A illustrates a case where the rectangle 32 is displayed at a gray-scale level which is in the prohibited range. FIG. 5B illustrates a case where the rectangle 32 is displayed at a gray-scale level which falls outside the prohibited range.

In the case where a gray-scale level in the prohibited range is used, the liquid crystal layer has such a slow response speed that, as schematically shown in FIG. 5A, a right edge 32*a* of the rectangle 32 may not be clearly recognized, thus resulting in a blurring of the contour. On the other hand, if a gray-scale level outside the prohibited range is used, as schematically shown in FIG. 5B, the response speed is improved such that the right edge 32*a* can be clearly recognized. As a result, blurring of the contour is prevented.

Now, the different between the driving of the liquid crystal display device 100 according to the present invention and the so-called overshoot driving will be described.

In overshoot driving, an overshoot voltage corresponding to a gray-scale level which is different from a "regular" gray-scale level corresponding to an input image signal in the current frame is supplied. However, in overshoot driving, the "regular" gray-scale level is still targeted. Thus, a gray-scale voltage is supplied which is expected to cause the luminance to reach a luminance corresponding to the regular gray-scale level within one frame.

On the other hand, according to the driving of the liquid crystal display device 100, the target gray-scale level is not necessary a regular gray-scale level. In the case where an alternative gray-scale voltage is supplied, the target gray-scale level is not a regular gray-scale level, but an alternative gray-scale level. In other words, if the regular gray-scale level is found to be within the prohibited range (where the liquid crystal layer has a slow response speed), the target gray-scale level itself is changed to a gray-scale level which falls outside the prohibited range.

In overshoot driving, the target gray-scale level is always a regular gray-scale level. Therefore, in the case where there is a large difference between the regular gray-scale level and the displayed gray-scale level of the previous frame, the target luminance may not be reached within one frame, even if an overshoot voltage is applied, thus resulting in a degraded display quality. Hereinafter, this problem will be described more specifically.

In general, a liquid crystal layer has two types of response: "rise" and "fall". A "rise" is a change in displaying state responsive to an increase in the voltage applied across the liquid crystal layer. A "fall" is a change in displaying state responsive to a decrease in the voltage applied across the liquid crystal layer. In a liquid crystal display device of a normally black mode, a "rise" corresponds to an increase in transmittance, whereas a "fall" corresponds to a decrease in transmittance.

Figure 6:
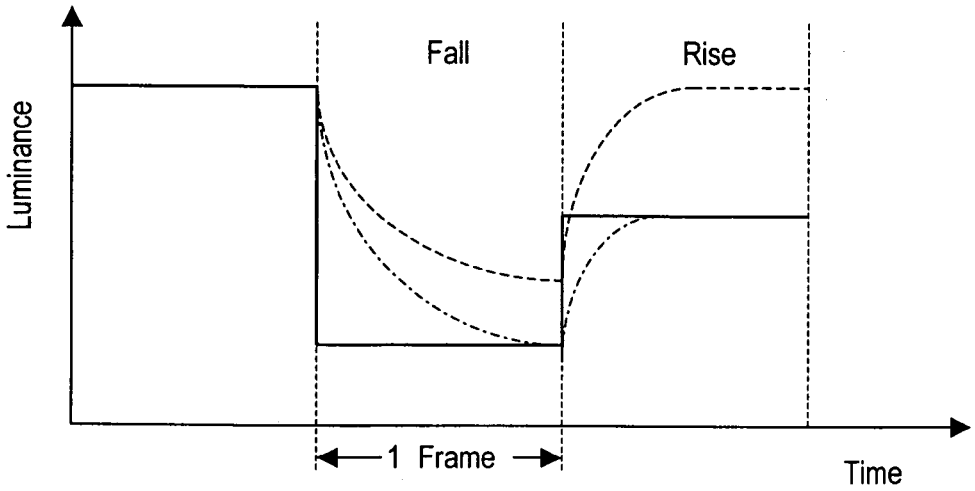
FIG. 6 is a graph for explaining a whitening-out problem associated with overshoot driving.

FIG. 6 shows changes over time in the luminance of a liquid crystal display device which performs overshoot driving, illustrating a case where fall and rise responses occur in this order. In this case, it would be preferable that a luminance corresponding to the target gray-scale level be reached within one frame, as shown by dot-dash lines in FIG. 6. However, in an actual liquid crystal display device, as shown by broken lines in FIG. 6, the luminance may not decrease to a luminance corresponding to the target gray-scale level within one frame, during a fall response. When an overshoot voltage for a rise response is applied in this state, the luminance will become higher than the luminance corresponding to the target gray-scale level, thus resulting in a "whitening-out" problem (which herein refers to a phenomenon where a gray-scale level which is much higher than the target gray-scale level is displayed in some of the pixels in the panel). One conceivable technique for solving this problem might be to store the gray-scale data over several frames to a frame memory, perform calculation to predict the current luminance from this data, and determine an overshoot voltage based on the predicted luminance. However, doing so would result in an increased production cost because of the need to provide a frame memory having a large capacity and circuitry for handling complicated calculations.

On the other hand, according to the liquid crystal display device 100, the target gray-scale level itself is changed. Therefore, within one vertical scanning period, the amount of luminance change will always reach a predetermined fraction of the target change amount, whereby the aforementioned whitening-out problem is prevented. Moreover, since it is unnecessary to employ a complicated circuit construction as will be necessitated in overshoot driving for suppressing whitening-out, it is possible to perform the driving with a simple constitution.

Another problem may be that liquid crystal panels which fall under the same specifications may actually have varying response characteristics due to fluctuations in the production process. Therefore, given a plurality of liquid crystal panels falling under the specifications, an optimum overshoot voltage which is set with respect to a certain liquid crystal panel may not be optimum with respect to another liquid crystal panel. In other words, if an overshoot voltage which is set with respect to a liquid crystal panel is applied to another liquid crystal panel, degradation in display quality, e.g., the aforementioned whitening-out problem, may occur.

On the other hand, in accordance with the liquid crystal display device 100, the liquid crystal panel 10 receives a gray-scale voltage (a regular gray-scale voltage corresponding to the regular gray-scale level or an alternative gray-scale voltage corresponding to an alternative gray-scale level) such that the resultant amount of luminance change will reach the predetermined fraction of the target change amount within one frame. Therefore, even in the case where the response characteristics of the liquid crystal panel 10 may vary, the whitening-out problem as illustrated in FIG. 6 is unlikely to occur.

The fact that the target gray-scale level is changed in the case of supplying an alternative gray-scale voltage implies that the displayed image may not be an accurate reproduction of the input image signal. However, the aforementioned selective supplying of gray-scale voltages will be repeatedly performed after the next frame. Therefore, in the case where the regular gray-scale level is retained at the same level over a plurality of frames, the target gray-scale level will gradually approximate, and finally become equal to, the regular gray-scale level. Therefore, in many cases, any difference between the target gray-scale level and the regular gray-scale level would only be transitional, and is unlikely to be recognized by the viewer. Moreover, by setting the alternative gray-scale level to a gray-scale level which is intermediate between the regular gray-scale level and the displayed gray-scale level of the previous vertical scanning period, it becomes possible to reduce the unnaturalness of the displayed image, thus making it even more difficult for the viewer to recognize the difference of the target gray-scale level from the regular gray-scale level.

As described above, the driving circuit 20 in the liquid crystal display device 100 classifies each combination of a displayed gray-scale level of a previous vertical scanning period and a regular gray-scale level corresponding to an input image signal in a current vertical scanning period into either a "first group" or a "second group". Specifically, a combination belongs to the "first group" if the luminance reaches $L_1+(L_2-L_1)\cdot C_1$ within a period corresponding to one vertical scanning period when a gray-scale voltage corresponding to the regular gray-scale level is supplied; otherwise, the combination belongs to the "second group". Herein, $L_1$ is a luminance corresponding to the displayed gray-scale level of the previous vertical scanning period; $L_2$ is a luminance corresponding to the regular gray-scale level; and $C_1$ is a predetermined constant which is greater than zero and equal to or less than 1.

For any combination in the first group (i.e., where the regular gray-scale level of the current vertical scanning period is within the tolerable range), the driving circuit 20 is able to supply a gray-scale voltage corresponding to the regular gray-scale level. On the other hand, for any combination in the second group (i.e., where the regular gray-scale level of the current vertical scanning period is within the prohibited range), the driving circuit 20 is able to supply a gray-scale voltage corresponding to a gray-scale level (alternative gray-scale level) which is different from the regular gray-scale level, the alternative gray-scale level being defined so that the luminance will reach $L_1+(L_3-L_1)\cdot C_2$ within a period corresponding to one vertical scanning period when the alternative gray-scale voltage is supplied. Herein, $L_3$ is a luminance corresponding to the alternative gray-scale level; and $C_2$ is a predetermined constant which is greater than zero and equal to or less than 1.

The present embodiment illustrates an example where the tolerable range and the prohibited range (i.e., the first group and the second group) are defined based on whether the amount of luminance change within a period corresponding to one frame reaches 90% of the target change amount or not. This corresponds to the case where the aforementioned constant $C_1$ is 0.9. Furthermore, this means that: when a regular gray-scale voltage is supplied with respect to a combination belonging to the first group, the luminance at least changes from $L_{1+0.1}\cdot(L_2-L_1)$ to $L_1+0.9\cdot(L_2-L_1)$ within a period corresponding to one vertical scanning period; and, when an alternative gray-scale voltage is supplied with respect to a combination belonging to the second group, the luminance at least changes from $L_1+0.1\cdot(L_3-L_1)$ to $L_1+0.9\cdot(L_3-L_1)$ within a period corresponding to one vertical scanning period.

Assuming that the luminance in the black displaying state (corresponding to the $0^{th}$ gray-scale level) is 0 and that the luminance in the white displaying state (corresponding to the highest gray-scale level) is 1, consider a combination in which the displayed gray-scale level of the previous frame is a gray-scale level corresponding to a luminance of 0.1 and the regular gray-scale level of the current frame is a gray-scale level corresponding to a luminance of 0.2, for example. If the regular gray-scale voltage causes the luminance to reach 0.19 ($=L_1+(L_2-L_1)\cdot C=0.1+(0.2-0.1)\cdot(0.9)$) within a period corresponding to one frame, this combination belongs to the first group; if not, this combination belongs to the second group. For another example, consider a combination in which the displayed gray-scale level of the previous frame is a gray-scale level corresponding to a luminance of 0.9 and the regular gray-scale level of the current frame is a gray-scale level corresponding to a luminance of 0.1. If the regular gray-scale voltage causes the luminance to reach $0.18(=L_1+(L_2-L_1)\cdot C=0.9+(0.1-0.9)\cdot(0.9))$ within a period corresponding to one frame, this combination belongs to the first group; if not, this combination belongs to the second group.

As the fraction (corresponding to the constant $C_1$) for defining the prohibited range and the tolerable range (i.e., the first group and the second group), any other value may be used. Although a "target gray-scale level" can be safely considered as being attained if the amount of luminance change within a period corresponding to one vertical scanning period reaches 90% of the target change amount, when the human visual characteristics are taken into consideration, a "target gray-scale level" may actually be considered as being attained if the amount of luminance change reaches 80% of the target change amount.

Therefore, the tolerable range and the prohibited range (i.e., the first group and the second group) may be defined based on whether the amount of luminance change reaches 80% of the target change amount or not. This would correspond to the case where the aforementioned constant $C_1$ is 0.8. Furthermore, this would mean that: when a regular gray-scale voltage is supplied with respect to a combination belonging to the first group, the luminance at least changes from $L_1+0.2\cdot(L_2-L_1)$ to $L_1+0.8\cdot(L_2-L_1)$ within a period corresponding to one vertical scanning period; and, when an alternative gray-scale voltage is supplied with respect to a combination belonging to the second group, the luminance at least changes from $L_1+0.2\cdot(L_3-L_1)$ to $L_1+0.8\cdot(L_3-L_1)$ within a period corresponding to one vertical scanning period.

It will be appreciated that the constant $C_1$ is not limited to 0.8 or 0.9. From the perspective of improving the moving picture displaying characteristics, the constant $C_1$ is preferably equal to or greater than 0.8, and more preferably equal to or greater than 0.9. Similarly, the constant $C_2$ is preferably equal to or greater than 0.8, and more preferably equal to or greater than 0.9. The constant $C_1$ and the constant $C_2$ may or may not be equal to each other.

As in the driving circuit 20 of the present embodiment, by adopting a constitution where a look-up table is referred to in making the distinction between the first and second groups (with respect to each combination of a displayed gray-scale level of a previous vertical scanning period and a regular gray-scale level of a current vertical scanning period) as well as the determination of the gray-scale voltage to be supplied, it becomes possible to realize selective supplying of a regular gray-scale voltage or an alternative gray-scale voltage with a simple structure, although the scope of invention is not to be limited to the above constitution.

(Embodiment 2)

Figure 7:
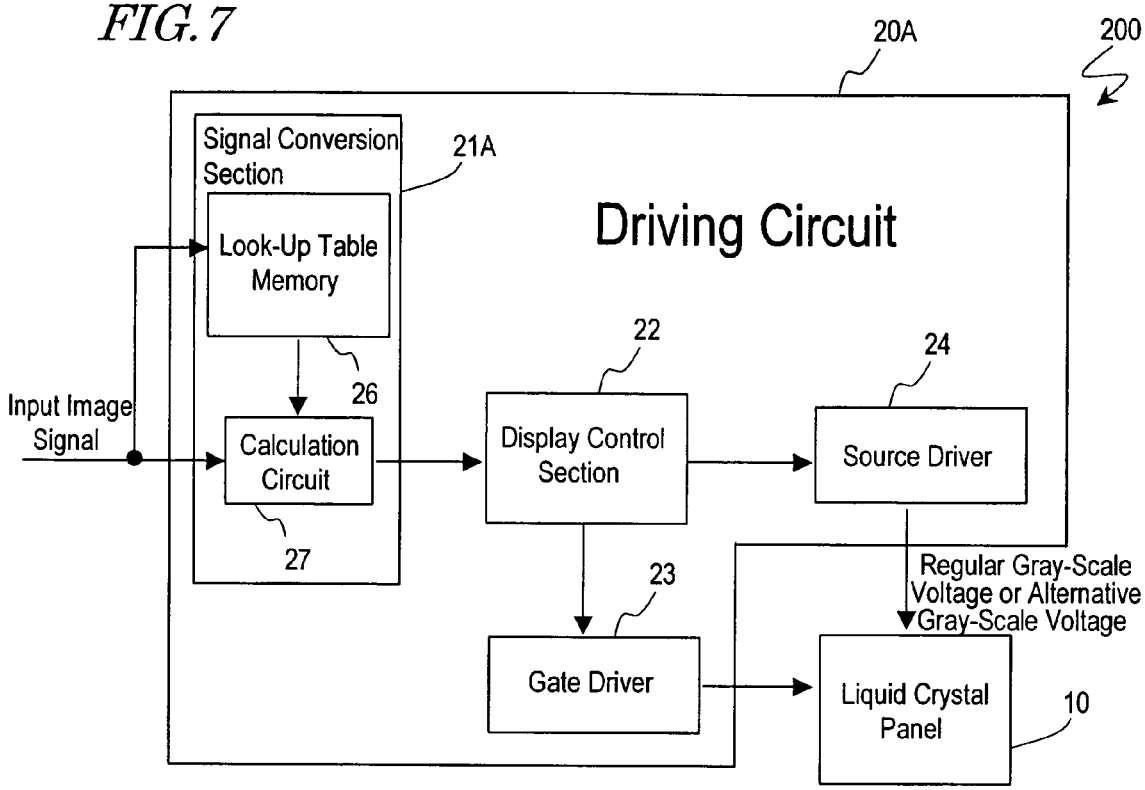
FIG. 7 is a block diagram schematically showing a liquid crystal display device 200 according to another embodiment of the present invention.

With reference to FIG. 7, a liquid crystal display device 200 according to the present embodiment will be described. Hereinafter, the differences from the liquid crystal display device 100 of Embodiment 1 will be mainly described.

If a regular gray-scale level corresponding to an input image signal in the current frame is a gray-scale level within a specific range, a driving circuit 20A of the liquid crystal display device 200 is able to supply a gray-scale voltage ("regular gray-scale voltage") corresponding to the regular gray-scale level. On the other hand, if the regular gray-scale level is a gray-scale level falling outside the specific range, the driving circuit 20A is able to supply a gray-scale voltage ("alternative gray-scale voltage") corresponding to a gray-scale level which is different from the regular gray-scale level (referred to as an "alternative gray-scale level" also in the present embodiment) but which falls within the specific range.

The aforementioned specific range is the "tolerable range" (i.e., outside the prohibited range) as defined when supplying a gray-scale voltage in the black displaying state. In other words, after the lapse of a period corresponding to one vertical scanning period, from when a gray-scale voltage corresponding to a gray-scale level within the specific range is supplied in the black displaying state, the luminance is equal to or greater than $L_1+(L_2-L_1)\cdot C$. On the other hand, after the lapse of a period corresponding to one vertical scanning period, from when a gray-scale voltage corresponding to a gray-scale level falling outside the specific range is supplied in the black displaying state, the luminance is less than $L_1+(L_2-L_1)\cdot C$. Herein, the constant C may for example be 0.8 or 0.9, and is preferably equal to or greater than 0.8, and more preferably equal to or greater than 0.9.

FIG. 8 shows a relationship between a displayed gray-scale level of a previous frame and a regular gray-scale level of a current frame, as well as a gray-scale voltage level which is actually supplied by the driving circuit 20A. Note that the relationship shown in FIG. 8 is that of a liquid crystal panel 10 having the response characteristics as shown in FIG. 4. Moreover, in FIG. 8, the gray-scale level and the gray-scale voltage level are represented in terms of luminance ratio, as is the case with the horizontal axis in FIG. 4.

As seen from FIG. 8, if the regular gray-scale level of the current frame is a gray-scale level within the tolerable range (i.e., a luminance ratio of no less than 0 and no more than 0.02, or a luminance ratio of no less than 0.27 and no more than 1.00), a regular gray-scale voltage is to be supplied. On the other hand, if the regular gray-scale level of the current frame falls outside the tolerable range, that is, falls within the prohibited range (i.e., a luminance ratio greater than 0.02 and less than 0.27), a gray-scale voltage which falls within the tolerable range is to be supplied as an alternative gray-scale voltage. Thus, irrespective of the displayed gray-scale level of a previous frame, the level of the gray-scale voltage to be supplied to the liquid crystal panel 10 is determined in accordance with the regular gray-scale level of the current frame.

Thus, since there is no need to consider the displayed gray-scale level of the previous frame, a frame memory for storing gray-scale data of a previous frame can be omitted from the signal conversion section 21A, as shown in FIG. 7. As a result, the production cost can be reduced. Moreover, the look-up table contained in the look-up table memory 26 of the signal conversion section 21A does not need to have a matrix structure, but simply may have a one-row-against-plural-columns structure as shown in FIG. 9. Since the look-up table can be generated based only on the response characteristics from the black displaying state, the generation of the look-up table can be simplified.

The structure illustrated in the present embodiment is suitably used in a VA-type liquid crystal display device whose liquid crystal layer is a vertical-alignment type liquid crystal layer. The liquid crystal molecules contained in a vertical-alignment type liquid crystal layer are aligned substantially perpendicular to the substrate face in the absence of an applied voltage, and, under an applied voltage, incline at an angle which is in accordance with the level of the applied voltage. A vertical-alignment type liquid crystal layer is typically composed of a liquid crystal material having negative dielectric anisotropy, and its alignment is restricted by vertical alignment films formed on its sides.

In a VA-type liquid crystal display device, regardless of the orientation state in the previous frame, the transition to an orientation state in which the liquid crystal molecules are slightly inclined is slow, which gives a good reason for employing the structure illustrated in the present embodiment. Examples of VA-type liquid crystal display devices may be an MVA-type liquid crystal display device as disclosed in Japanese Laid-Open Patent Publication No. 2000-231091, and a CPA (Continuous Pinwheel Alignment) type liquid crystal display device as disclosed in Japanese Laid-Open Patent Publication No. 2003-43525.

Next, another structure which is applicable to the liquid crystal display device 100 of Embodiment 1 and the liquid crystal display device 200 of Embodiment 2 will be described.

Generally speaking, the response characteristics of the liquid crystal panel 10 are improved as the temperature increases. Therefore, it is preferable to provide a plurality of look-up tables corresponding to different panel temperatures, and selectively use an appropriate one of the tables. Moreover, in a liquid crystal display device incorporating a lighting device such as a backlight, the temperature of the liquid crystal panel 10 is likely to become much higher than room temperature due to the heat generated by the lighting device. In about tens of seconds since activation of the lighting device, the surface temperature of the liquid crystal panel 10 may reach about 50° C. to 60° C. This can enhance the response characteristics of the liquid crystal panel 10 to such an extent that a sufficient response speed is obtained for any change in gray-scale level. In this case, driving may be performed in such a manner that a regular gray-scale voltage is always performed at a certain temperature (e.g. 40° C.) or above.

Figure 10:
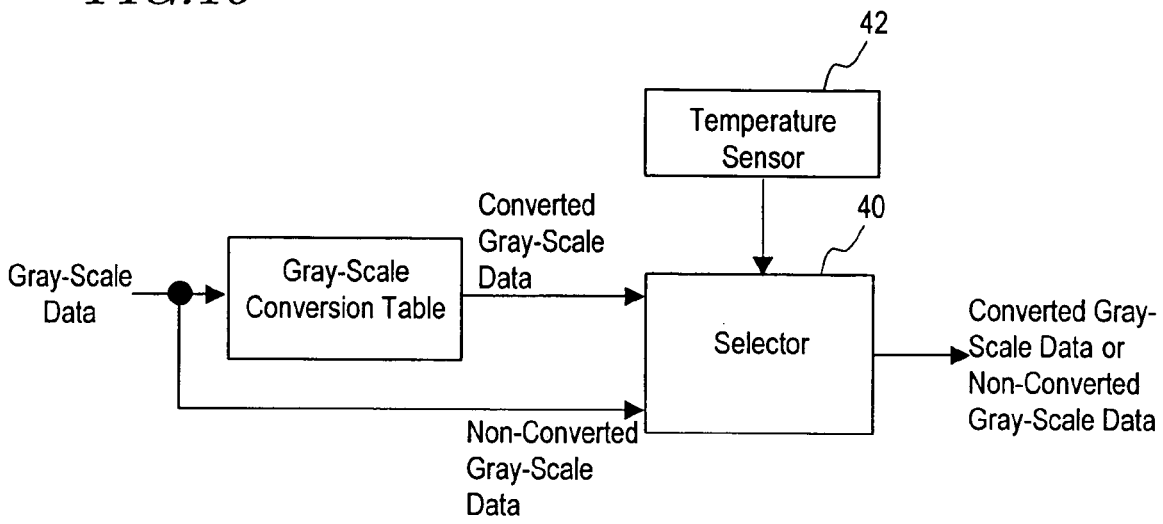
FIG. 10 is a diagram showing an exemplary signal processing which may be applied to the liquid crystal display devices 100 and 200 according to the present invention.

FIG. 10 shows an example of such signal processing. As shown in FIG. 10, gray-scale data corresponding to the input image signal is, on the one hand, input to a selector 40 after being converted into converted gray-scale data by using a gray-scale conversion table, and on the other hand, input to the selector 40 as non-converted gray-scale data without being subjected to the gray-scale conversion table. Then, depending on the temperature of the liquid crystal panel 10 as detected by a temperature sensor 42, the selector 40 selectively outputs either one of the converted gray-scale data or the non-converted gray-scale data. For example, the selector 40 may output the converted gray-scale data when the temperature of the liquid crystal panel 10 is lower than 40° C., and output the non-converted gray-scale data when the aforementioned temperature is 40° C. or above.

Moreover, in the case where it is previously known that the liquid crystal panel 10 will reach a predetermined temperature (at which sufficient response characteristics are guaranteed) in a predetermined time after activation of the liquid crystal display device, the driving circuit 20 (20A) may be controlled so that only a regular gray-scale voltage is supplied after the lapse of the predetermined time since activation, by utilizing a timer or the like.

As described above, a liquid crystal display device according to the present invention is capable of high-quality displaying of moving pictures with a simple constitution, and therefore is suitably used as a display device for various electronic apparatuses. Note that an image displayed by the liquid crystal display device of the present invention may sometimes be a less-than-accurate reproduction of the input image signal. Therefore, the liquid crystal display device of the present invention is more suitably used in an electronic apparatus which is more likely to display contrived images rather than natural images. For example, the liquid crystal display device of the present invention may be suitably used for a car navigation system, a monitor device for a personal computer (PC), or an instrument panel for an automotive vehicle. In particular, electronic apparatuses to be mounted in an automotive vehicle must be capable of fast operation even at a low temperature; therefore, particularly outstanding effects can be obtained when the present invention is applied to a liquid crystal display device for use in such apparatuses. As used herein, an "automotive vehicle" may be any vehicle or machine which is capable of self propulsion and used for passenger or article transportation or moving of objects, e.g., a car, a motorcycle, a bus, a truck, a tractor, an airplane, a motorboat, a vehicle for civil engineering use, a train, or the like. It will be appreciated that "automotive vehicles" are not limited to only those which are provided with internal combustion engines such as gasoline engines, but also encompass those provided with electric motors.

According to the present invention, there is provided a liquid crystal display device which is capable of high-quality displaying of moving pictures with a simple constitution, as well as a driving method for the same. The liquid crystal display device according to the present invention is suitably used in various electronic apparatuses, such as a car navigation system, a monitor device for a personal computer (PC), or an instrument panel for an automotive vehicle.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

This non-provisional application claims priority under 35 USC §119(a) on Patent Applications No. 2004-219557 filed in Japan on Jul. 28, 2004 and No. 2005-174731 filed in Japan on Jun. 15, 2005, the entire contents of which are hereby incorporated by reference.

What is claimed is:

1. A liquid crystal display device comprising:

a liquid crystal panel having a liquid crystal layer and at least a pair of electrodes for applying a voltage across the liquid crystal layer; and a driving circuit for supplying a driving voltage to the liquid crystal panel;

the driving circuit configured to classify a combination of a displayed gray-scale level of a previous vertical scanning period and a regular gray-scale level corresponding to an input image signal in a current vertical scanning period into either a first group or a second group, the combination is classified into the first group if a luminance of $L_1+(L_2-L_1)\cdot C_1$ is reached within a period corresponding to one vertical scanning period when a gray-scale voltage corresponding to the regular gray-scale level is supplied and the combination is classified into the second group if not classified in the first group, $L_1$ being a luminance corresponding to the displayed gray-scale level of the previous vertical scanning period, $L_2$ being a luminance corresponding to the regular gray-scale level, and $C_1$ being a first constant which is greater than zero and equal to or less than 1; and the driving circuit is configured to supply the gray-scale voltage corresponding to the regular gray-scale level for all combination belonging to the first group, and supply a gray-scale voltage corresponding to an alternative gray-scale level for any combination belonging to the second group, the alternative gray-scale level being different from the regular gray-scale level, wherein the alternative gray-scale level corresponds to a luminance of $L_1+(L_3-L_1)\cdot C_2$ being reached within a period corresponding to one vertical scanning period when the gray-scale voltage corresponding to the alternative gray-scale level is supplied, $L_3$ being a luminance corresponding to the alternative gray-scale level, and $C_2$ being a second constant which is greater than zero and equal to or less than 1.

2. The liquid crystal display device of claim 1, wherein the first and second constants $C_1$ and $C_2$ are equal to each other.

3. The liquid crystal display device of claim 1, wherein the alternative gray-scale level is a gray-scale level which is an intermediate level between the regular gray-scale level and the displayed gray-scale level of the previous vertical scanning period.

4. The liquid crystal display device of claim 1, wherein the driving circuit includes a look-up table that stores a plurality of combinations of the displayed gray-scale level of the previous vertical scanning period and the regular gray-scale level corresponding to the input image signal in the current vertical scanning period, and supplies a gray-scale voltage based on the look-up table.

5. The liquid crystal display device of claim 1, wherein after a time has elapsed since activation of the liquid crystal display device, the driving circuit only supplies a gray-scale voltage corresponding to the regular gray-scale level.

6. The liquid crystal display device of claim 1, wherein the first constant $C_1$ is equal to or greater than 0.8.

7. The liquid crystal display device of claim 6, wherein when the gray-scale voltage corresponding to the regular gray-scale level is supplied for combinations belonging to the first group, at least a luminance change from $L_1+0.2\cdot(L_2$31 $L_1)$ to $L_1+0.8\cdot(L_2-L_1)$ occurs within a period corresponding to one vertical scanning period.

8. The liquid crystal display device of claim 1, wherein the first constant $C_1$ is equal to or greater than 0.9.

9. The liquid crystal display device of claim 8, wherein when the gray-scale voltage corresponding to the regular gray-scale level is supplied for combinations belonging to the first group, at least a luminance change from $L_1+0.1\cdot(L_2-L_1)$ to $L_1+0.9\cdot(L_2-L_1)$ occurs within a period corresponding to one vertical scanning period.

10. The liquid crystal display device of claim 1, wherein the second constant $C_2$ is equal to or greater than 0.8.

11. The liquid crystal display device of claim 10, wherein when the gray-scale voltage corresponding to the alternative gray-scale level is supplied for combinations belonging to the second group, at least a luminance change from $L_1+0.2\cdot(L_3-L_1)$ to $L_1+0.8\cdot(L_3-L_1)$ occurs within a period corresponding to one vertical scanning period.

12. The liquid crystal display device of claim 1, wherein the second constant $C_2$ is equal to or greater than 0.9.

13. The liquid crystal display device of claim 12, wherein when the gray-scale voltage corresponding to the alternative gray-scale level is supplied for combinations belonging to the second group, at least a luminance change from $L_1+0.1\cdot(L_3-L_1)$ to $L_1+0.9\cdot(L_3-L_1)$ occurs within a period corresponding to one vertical scanning period.

14. The liquid crystal display device of claim 1, further comprising a temperature sensor for detecting a temperature of the liquid crystal panel, wherein the driving circuit only supplies a gray-scale voltage corresponding to the regular gray-scale level if the temperature of the liquid crystal panel as detected by the temperature sensor is equal to or greater than a temperature.

15. The liquid crystal display device of claim 14, wherein the temperature is 40° C.

16. A liquid crystal display device comprising:

a liquid crystal panel having a liquid crystal layer and at least a pair of electrodes for applying a voltage across the liquid crystal layer; and a driving circuit for supplying a driving voltage to the liquid crystal panel, wherein the driving circuit is configured to supply a gray-scale voltage corresponding to a regular gray-scale level if the regular gray-scale level is a gray-scale level falling within a specific range, and configured to supply a gray-scale voltage corresponding to an alternative gray-scale level if the regular gray-scale level falling outside the specific range, the alternative gray-scale level being a gray-scale level within the specific range but different from the regular gray-scale level, the specific range being predefined such that a luminance is equal to or greater than $L_1+(L_2-L_1)\cdot C$ when a period corresponding to one vertical scanning period has elapsed since a gray-scale voltage corresponding to a gray-scale level falling within the specific range is supplied in a black displaying state, $L_1$ being a luminance corresponding to the displayed gray-scale level of the previous vertical scanning period, $L_2$ being a luminance corresponding to the regular gray-scale level, and C being a constant which is greater than zero and equal to or less than 1.

17. The liquid crystal display device of claim 16, wherein the liquid crystal layer is a vertical-alignment type liquid crystal layer.

18. The liquid crystal display device of claim 16, wherein the constant C is equal to or greater than 0.8.

19. The liquid crystal display device of claim 18, wherein when a gray-scale voltage corresponding to a gray-scale level falling within the specific range is supplied in a black displaying state, at least a luminance change from $L_1+0.2\cdot(L_2-L_1)$ to $L_1+0.8\cdot(L_2-L_1)$ occurs within a period corresponding to one vertical scanning period.

20. The liquid crystal display device of claim 16, wherein the constant C is equal to or greater than 0.9.

21. The liquid crystal display device of claim 20, wherein when a gray-scale voltage corresponding to a gray-scale level falling within the specific range is supplied in a black displaying state, at least a luminance change from $L_1+0.1\cdot(L_2-L_1)$ to $L_1+0.9\cdot(L_2-L_1)$ occurs within a period corresponding to one vertical scanning period.

22. A driving method for a liquid crystal display device including a liquid crystal panel having a liquid crystal layer and at least a pair of electrodes for applying a voltage across the liquid crystal layer, the method comprising:

step (a) of classifying a combination of a displayed gray-scale level of a previous vertical scanning period and a regular gray-scale level corresponding to an input image signal in a current vertical scanning period into either a first group or a second group, the combination is classified into the first group if a luminance of $L_1+(L_2-L_1)\cdot C_1$ is reached within a period corresponding to one vertical scanning period when a gray-scale voltage corresponding to the regular gray-scale level is supplied and the combination is classified into the second group if not classified in the first group, $L_1$ being a luminance corresponding to the displayed gray-scale level of the previous vertical scanning period, $L_2$ being a luminance corresponding to the regular gray-scale level, and $C_1$ being a first constant which is greater than zero and equal to or less than 1;

step (b) of supplying the gray-scale voltage corresponding to the regular gray-scale level for any combination belonging to the first group; and step (c) of supplying a gray-scale voltage corresponding to an alternative gray-scale level-for any combination belonging to the second group, the alternative gray-scale level being different from the regular gray-scale level, wherein the alternative gray-scale level corresponds to a luminance of $L_1+(L_3-L_1)\cdot C_2$-being reached within a period corresponding to one vertical scanning period when the gray-scale voltage corresponding to the alternative gray-scale level is supplied, $L_3$ being a luminance corresponding to the alternative gray-scale level, and $C_2$ being a second constant which is greater than zero and equal to or less than 1.

23. The driving method of claim 22, wherein step (a) is executed by referring to a look-up table for the combination of the displayed gray-scale level of the previous vertical scanning period and the regular gray-scale level corresponding to the input image signal in the current vertical scanning period; and step (b) and step (c) are executed by supplying a gray-scale voltage based on the look-up table.

* * * * *